United States Patent [19]

Sjöbom

[11] 3,977,611

[45] Aug. 31, 1976

[54] APPARATUS FOR REFINING FIBER MATERIAL

[75] Inventor: Axel Henning Sjöbom, Njurunda, Sweden

[73] Assignee: SCA Development Aktiebolag, Sundsvall, Sweden

[22] Filed: Mar. 20, 1975

[21] Appl. No.: 560,542

[30] Foreign Application Priority Data

Mar. 27, 1974 Sweden ..... 7404131

[52] U.S. Cl. ..... 241/251; 241/259.2

[51] Int. Cl.[2] ..... B02C 7/06; B02C 7/14

[58] Field of Search ..... 241/251, 259.1, 259.2, 241/259.3

[56] References Cited

UNITED STATES PATENTS

| | | | |
|---|---|---|---|
| 2,743,874 | 5/1956 | Asplund | 241/259.1 X |
| 3,212,721 | 10/1965 | Asplund et al. | 241/259.2 X |
| 3,323,731 | 6/1967 | Asplund et al. | 241/259.2 X |
| 3,717,308 | 2/1973 | Reinhall | 241/259.2 X |

*Primary Examiner*—Granville Y. Custer, Jr.
*Assistant Examiner*—Howard N. Goldberg
*Attorney, Agent, or Firm*—Lerner, David, Littenberg & Samuel

[57] ABSTRACT

Apparatus for refining fibrous material which includes two oppositely rotating refining discs each supported on a shaft, which shafts are rotatably mounted on a base. Bearing means are provided for the shafts which are adapted to receive the axial forces applied to the shafts during the refining operation. The bearing means includes at least two axial bearings on each shaft and a piston and cylinder arrangement on each shaft connected to the base for transferring the axial forces from the axial bearings to the base.

8 Claims, 3 Drawing Figures

APPARATUS FOR REFINING FIBER MATERIAL

BACKGROUND OF THE INVENTION

This invention relates to apparatus for refining fibrous material, which comprises two oppositely rotating refining discs, between which the fibrous material is fed and refined during its passage through the clearance between the discs.

The two refining discs are each arranged at the end of different shafts, and the shafts are driven in opposite directions by two motors. Each of the shafts is supported in axial bearings, which are disposed on one end of the shafts adjacent each refining disc and at the opposite ends of the shafts.

During the refining operation, very high axial forces develop due to the high pressure in the disc clearance. Accordingly, the axial bearings are subjected to stresses of such a magnitude that for each shaft more than one axial bearing must be provided. This gives rise to the problem, that the load distribution between the axial bearings readily will become non-uniform and wil not be in proportion to the bearing capacity factor of each of the bearings.

SUMMARY OF THE INVENTION

The problem of non-uniform load distributions on the axial bearings is overcome by the present invention which allows the bearing capacity of each of the axial bearings to be utilized in an optimum manner, so that the maximum pressure applied to the discs can be increased. The present invention includes oppositely rotating refining discs each being supported on a shaft which is rotatably mounted on a base. Bearing means are provided on the shafts which are adapted to receive the axial forces developed during the refining operation. The bearing means include at least one axial bearing on each of the shafts and a piston and cylinder arrangement on each shaft connected to the base for transferring the axial forces from the axial bearings to the base.

In the preferred embodiment, the piston and cylinder arrangement for one shaft includes a hydraulic cylinder having two pistons which are concentrically arranged therein. One axial bearing on each shaft is adapted to engage a pressure plate which in turn is adapted to engage a piston rod, with the piston rod being connected to the piston and cylinder arrangement for that shaft and is dimensioned so as to prevent possible inclination and radial movement of the pressure plate. Further, one of the shafts is axially displaceable and is provided with indicating means which operate to actuate a control valve to adjust the fluid pressure of the piston and cylinder arrangements. In addition, the piston areas of the piston and cylinder arrangements may be of equal size so that the axial bearings for each shaft will receive axial forces of equal size.

Further objects, features and advantages of the invention will become apparent upon a consideration of the following detaled description of a presently preferred embodiment when taken in conjunction with the accompanying drawing, wherein.

DETAILED DESCRIPTION OF A PREFERRED EMBODIMENT

Figure 1:
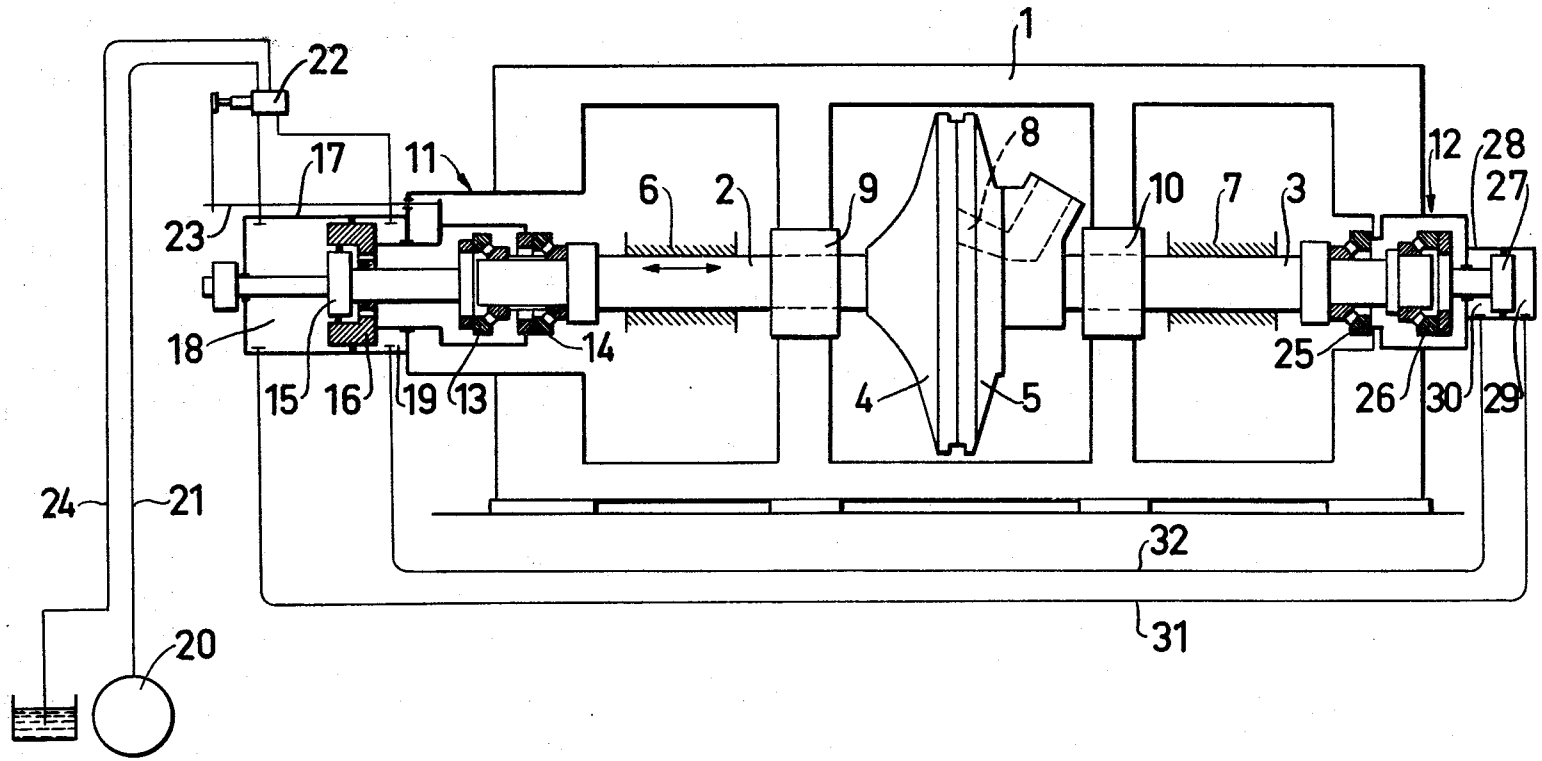
FIG. 1 is a schematic diagram of a refiner provided with the apparatus according to the invention.

The refiner comprises a base 1, which by means of bearings supports two shafts 2, 3, which are provided with two opposed refining discs 4, 5. The shaft 2 with the refining disc 4 are rotated in one direction by motor 6 disposed about shaft 2, and shaft 3 with the refining disc 5 are rotated in an opposite direction by motor 7 disposed about shaft 3.

Shaft 2 with the refining disc 4 is axially movable for adjusting the size of the clearance between discs 4, 5 (control end). The other disc 5 is provided with channel 8 adjacent its centre for feeding-in the material to be refined (feed end).

Each shaft 2, 3 is supported in two places, by bearings 9, 10 adjacent the respective refining discs 4, 5 and by bearings 11, 12 at its other end. The bearings 11, 12 at the ends of the shafts are arranged to receive the axial forces. As the axial forces must balance each other, the two bearings 11, 12 are adapted to receive axial forces of equal size.

The bearing 11 at the control end comprises two axial bearings 13, 14, each of which communicates with a respective piston 15, 16 in a cylinder 17. The two pistons 15, 16 are arranged concentrically and are slightly displaceable relative to each other, and they define two chambers 18, 19 in the cylinder 17. The pressure applied to the refining discs 4, 5 is produced by a hydraulic pressure medium, such as oil, being supplied to the outer chamber 18. The pressure prevailing in the outer chamber 18 acts upon the pistons 15, 16, which thereby transfer to the respective axial bearings 13, 14 a force being proportional to the area of the piston in question. Thus, when the piston areas are of equal size, the two axial bearings 13, 14 will receive axial forces of equal size. As the inner bearing 14 also will receive radial forces, the pistons 15, 16 preferably are so dimensioned that the two bearings will have an equally long service life.

The necessary hydraulic pressure is produced by a pump 20, which pumps the pressure medium through a conduit 21 to the cylinder 17 via a conventional control valve 22. The control valve 22 is actuated by an indicating member 23 indicating the axial position of the shaft 2. The desired axial position, i.e., the desired size of the clearance between discs 4, 5 can be set, and a change in the axial position implies that the pressure medium through the conduit 21 is supplied either to the outer chamber 18 or the inner chamber 19, so that the desired position is restored. From the opposite chamber 18 or 19 the pressure medium then is returned via the control valve 22 through a return conduit 24.

The bearing 12 at the feed end also comprises two axial bearings 25, 26, of which one bearing 25 is supported against a stop member rigidly attached to the base 1, and the other bearing 26 communicates with a piston 27 being movable in a cylinder 28. The piston 27 defines two chambers, an outer chamber 29 and an inner chamber 30, in the cylinder 28.

The outer chamber 29 communicates with the outer chamber 18 through a conduit 31 for the pressure medium, and the inner chamber 30 communicates with the inner chamber 19 through a conduit 32 for the pressure medium. The hydraulic pressure in the chambers 18 and 29 will thereby be of equal size. The force transferred between the piston 27 and the axial bearing 26 is proportional to the area of piston 27. When the area of the piston 27 is dimensioned to have a size equal to the areas of the pistons 15 and, respectively, 16, the axial forces will be distributed uniformly between the associated axial bearings 13, 14 and 26. As the axial forces must balance each other, the stationary axial bearing 25 will also receive a similar axial force. As the bearing 25, like the bearing 14, also receives radial forces, the piston areas are adapted so as to render the same service life to all bearings.

It is, thus, possible by the arrangement described above to distribute the refining forces developed during the refining operation between several axial bearings in proportion to their bearing capacity factor.

According to the embodiment shown, two axial bearings are provided on each shaft, but it is, of course, also possible to provide three or more bearings, when applying the principles of the invention. At the control end for example, a piston would be connected to each additional axial bearing which is movable in the same cylinder as the other pistons and is actuated by the same hydraulic pressure. At the feed end, in a corresponding manner, a piston would also be added for each additional bearing.

Figure 2:
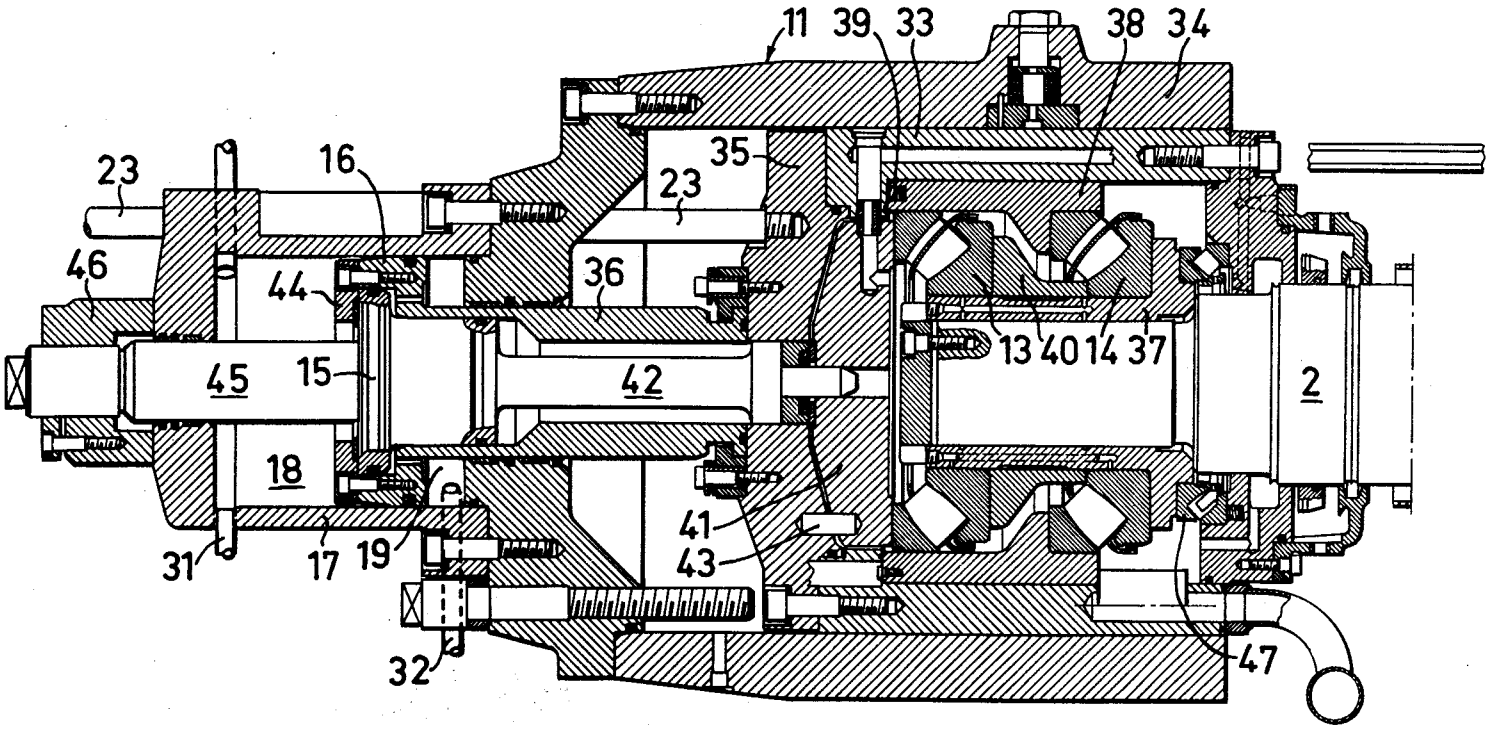
FIG. 2 is a detailed cross-sectional view of the bearing housing at the end of one shaft.

FIG. 2 shows in detail the bearing 11 at the control end. The bearing housing 33 is axially slidable in an outer bearing housing 34, which is rigidly connected to the base 1 and prevented by keying or the like from rotating in the outer housing. The bearing housing 33 communicates via an outer pressure plate 35 with a tubular piston rod 36, which extends into the cylinder 17 and on which the piston 16 is attached.

On the end of the shaft 2 a sleeve 37 is secured, on which the two axial bearings 13, 14 are mounted. The inner bearing 14 has axial support via a sleeve-shaped bearing member 38 against a shoulder in the bearing housing 33. Bearing member 38 is slightly movable in an axial direction and is prevented by keying or the like from rotating. Bearing clearance when the bearing is unloaded is prevented by the bearing member 38 being pressed against the bearing 14 by a spring 39 at the shoulder of the bearing housing 33. Alternatively, the bearing member 38 may be assembled with the bearing house 33, in which case the spring 39 is provided between the bearing 14 and the bearing member 38.

The outer bearing 13 is rigidly attached to the sleeve 37, and between the two bearings 13, 14 a distance member 40 is disposed. The bearing 13 is supported axially against an inner pressure plate 41, which in its turn abuts an inner piston rod 42, on which the piston 15 is mounted. The pressure plate 41 and the piston rod 42 are so arranged as to permit a certain inclination and radial movement in relation to the center line of the shaft. The pressure plate 41 is prevented from rotating by means of a pin 43 interconnecting the pressure plates 35 and 41.

The two pistons 15, 16 are rotatably and axially movable with respect to each other.

The inner piston 15 seals against the outer piston 16, which in turn seals against the cylinder 17. The inner piston 15 is prevented from sliding out of the outer cylinder by means of a stop ring 44 attached to the outer piston 16.

From the inner piston 15, a piston rod 45 projects outward through the opposite end of the cylinder 17 and is provided with a stop nut 46. This allows the shaft 2 to be displaced against a mechanic stop and thereby eliminates the risk of seizing of the refining discs. During normal operation of the apparatus according to the invention, this stop is not utilized, but the setting of the disc clearance is maintained by the hydraulic cylinder 17 by means of the control valve 22.

The indicating device 23 comprises a rod so connected to the outer pressure plate 35 as to accompany the plate in its axial movement. The rod projects out through an aperture in the end wall of the outer bearing housing and actuates the control valve 22 as stated above.

When the refining discs are pulled apart by means of the hydraulic cylinder 17, the bearings 13 and 14 are relieved. The force then being directed in the opposite direction is thereby transferred from the axially movable inner bearing housing 33 to the shaft 2 by means of a smaller axial bearing 47 disposed inside of the bearings 13 and 14.

Figure 3:
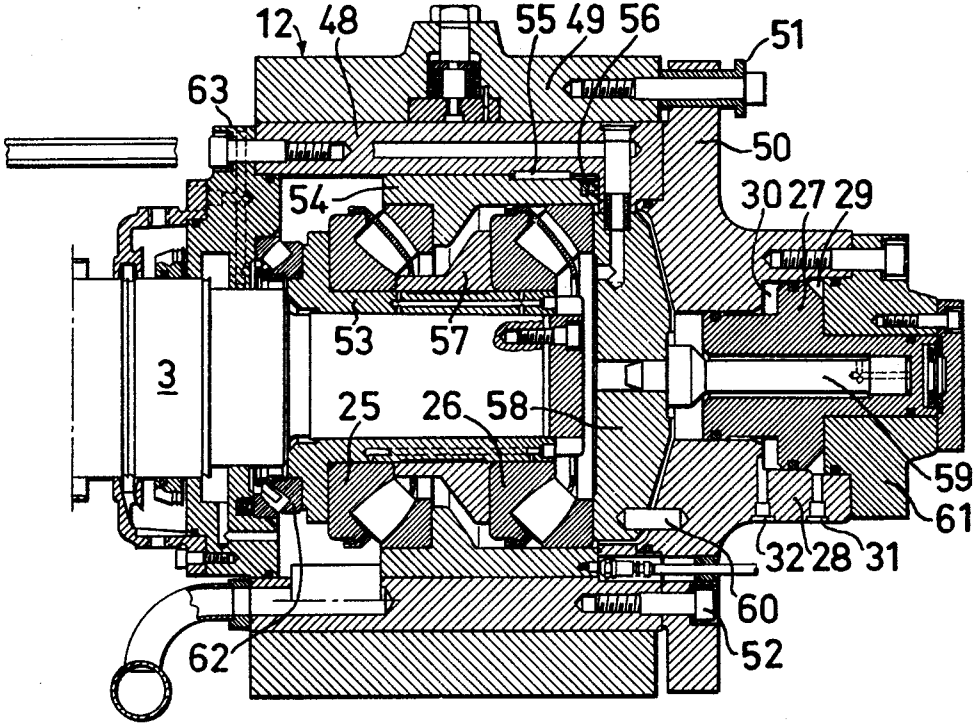
FIG. 3 is a detailed cross-sectional view of the bearing housing at the end of the other shaft.

In FIG. 3 the bearing 12 at the feed end is shown in detail. The bearing housing 48 is slightly displaceable axially in an outer bearing housing 49, which is rigidly connected to the base 1. The bearing housing 48 has axial support against the end wall 50 of the outer bearing housing 49. The axial position of the refining disc at the feed end, thus, is determined by the end wall 50 which, therefore, is adjustable in an axial direction by means of a plurality of set screws 51 distributed about its periphery. The bearing housing 48 is retained on the end wall 50 by means of bolts 52, which simultaneously prevent the bearing housing 48 from rotating in the outer housing 49. At the end of the shaft 3, a sleeve 53 is mounted, upon which the two axial bearings 25 and 26 are disposed. The inner bearing 25 is supported axially via a sleeve-shaped member 54 against a shoulder in the bearing housing 48. The bearing number 54 is slightly movable in an axial direction and is prevented by key 55 or the like from rotating.

Bearing clearance when the bearing is unloaded is prevented by the bearing member 54 being pressed against the bearing 25 by a spring 56 at the shoulder of the bearing housing 48.

The outer bearing 26 is rigidly attached to the sleeve 53, and between the bearings 25, 26 a distance member 57 is disposed. The bearing 26 is supported axially against a pressure plate 58, which at its center has support against a piston rod 59, on which the piston 27 is mounted. The pressure plate 58 is prevented from rotation by means of a pin 60 interconnecting the pressure plate with the end wall 50.

In the end wall 50 the cylinder 28 is formed, which is closed by a cover 61, which also is provided with a guide for the piston 27.

When the shaft 3 is loaded axially in the direction away from the bearing 12, the axial bearings 25, 26 are relieved and, instead, a smaller axial bearing 62 is put in operation. This bearing 62 is disposed inside of the two axial bearings 25, 26 between a shoulder on the sleeve 53 on the shaft 3 and the inner end wall 63 of the bearing housing 48.

The axial refining force developed during the refining operation will be transferred from the shaft 2 at the control end partly via the outer axial bearing 13, the inner pressure plate 41, the inner piston rod 42 to the inner piston 15 in the hydraulic cylinder 17 and partly via the inner axial bearing 14, the bearing member 38, the bearing housing 33, the outer pressure plate 35, the tubular piston rod 36 to the outer piston 16 in the hydraulic cylinder 17. The axial bearings 13, 14 are thereby subjected to an axial load in proportion to the active areas of the pistons 15, 16 respectively.

At the feed end, the axial refining force will be transferred from the shaft 3 partly via the inner axial bearing 25, the bearing member 54, the bearing housing 48 to the end wall 50 of the outer bearing housing 49 and partly via the outer axial bearing 26, the pressure plate 58, the piston rod 59, the piston 27, the pressure medium in the chamber 29 to end wall 50. The outer axial bearing 26 will be loaded by an axial force, which is determined by the pressure in the chamber 29 and the active piston area of the piston 27. The remaining axial force thereby loads the inner axial bearing 25.

A latitude of modification, change and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for refining fibrous material comprising a first shaft for supporting a first refining disc, a second shaft for supporting a second refining disc, a base mounting said first and second shafts and said refining discs for rotation in opposite directions, said first and second refining discs being in juxtaposed position to define a refining zone therebetween, at least one of said shafts being axially displaceable, bearing means for said shafts adapted to receive the axial forces developed during refining, said bearing means including at least a first and second axial bearing for said first shaft, first piston and cylinder means connected to said base for transferring the axial forces from said first axial bearing to said base, said bearing means further including at least a third and fourth axial bearing for said second shaft, a second piston and cylinder means connected to said base for transferring the axial forces from said third axial bearing to said base, said fourth axial bearing being arranged to transfer the axial forces directly to said base, and means for hydraulically connecting said first and second piston and cylinder means.

2. Apparatus according to claim 1 wherein said first piston and cylinder means includes a hydraulic cylinder having two pistons concentrically arranged therein.

3. Apparatus according to claim 1 further including a pressure plate and a piston rod wherein one axial bearing for said first shaft engages said pressure plate which in turn engages said piston rod, said piston rod being connected to said first piston and cylinder means and is constructed and arranged to permit inclination and radial movement of said pressure plate.

4. Apparatus according to claim 1 further including a pressure plate and a piston rod wherein one axial bearing for said second shaft engages said pressure plate which in turn engages said piston rod, said piston rod being connected to said second piston and cylinder means and is constructed and arranged to permit inclination and radial movement of said pressure plate.

5. Apparatus according to claim 1 further including an indicating member and a control valve wherein the axial position of said axially displaceable shaft is indicated by means of said indicating member which operates to actuate said control valve to adjust the pressure in said first piston and cylinder means.

6. Apparatus according to claim 1 further including means for supporting one of the axial bearings on each shaft so as to receive both radial and axial forces.

7. Apparatus according to claim 1 wherein said first and second piston and cylinder means each include a piston, the active areas of said pistons being constructed and arranged so that said axial bearings for each shaft receive axial forces of equal magnitude.

8. Apparatus according to claim 1 wherein said first piston and cylinder means includes a cylinder and a piston rod projecting out of said cylinder, a stop nut, said piston rod and said stop nut forming means for limiting the axial movement of said axially displaceable shaft.

* * * * *